United States Patent [19]

Buckley

[11] Patent Number: 4,503,605

[45] Date of Patent: Mar. 12, 1985

[54] METHOD OF MAKING A CELLULOSE-FREE ELECTRICAL WINDING

[75] Inventor: Richard D. Buckley, Watkinsville, Ga.

[73] Assignee: Westinghouse Electric Corp., Pittsburgh, Pa.

[21] Appl. No.: 524,227

[22] Filed: Aug. 18, 1983

Related U.S. Application Data

[63] Continuation of Ser. No. 264,151, May 15, 1981, abandoned.

[51] Int. Cl.[3] ..... H01F 7/06

[52] U.S. Cl. ..... 29/605; 336/205; 336/206; 427/116; 427/120; 427/420

[58] Field of Search ..... 29/605; 336/205, 206; 427/116, 117, 118, 120, 420

[56] References Cited

U.S. PATENT DOCUMENTS

| | | | |
|---|---|---|---|
| 3,477,126 | 11/1969 | Price | 29/605 |
| 3,963,882 | 6/1976 | Lewis | 29/605 X |
| 4,095,557 | 6/1978 | Croop et al. | 29/605 X |
| 4,160,178 | 7/1979 | Smith et al. | 310/43 |
| 4,362,263 | 12/1982 | Kwiecinski | 427/117 X |

*Primary Examiner*—Carl E. Hall

*Attorney, Agent, or Firm*—D. R. Lackey

[57] ABSTRACT

A method of making a cellulose-free electrical winding having a tubular configuration in which layers of insulating resin and conductors are alternately disposed in a concentric pattern, with opposite edges of the conductor turn layers being coated with overlapping layers of resin. The resin is applied as a liquid in thin layers as the winding is being formed, and the liquid resin is instantly gelled to provide mechanical support for the next winding layer.

13 Claims, 3 Drawing Figures

METHOD OF MAKING A CELLULOSE-FREE ELECTRICAL WINDING

This application is a continuation of application Ser. No. 264,151, filed May 15, 1981, abandoned.

BACKGROUND OF THE INVENTION

1. Field of the Invention

This invention relates to a cellulose-free transformer having low-voltage and high-voltage windings which are insulated by layers of resinous material.

2. Description of the Prior Art

The concept of a non-cellulose insulated transformer is not new. Notably cast resin transformers have been and are marketed today with the salient features of resistance to: short circuit, moisture degradation, mechanical vibration, eventful failures, and fire. Unfortunately, non-cellulose insulated transformers have been costly not only financially but in loadability.

SUMMARY OF THE INVENTION

In accordance with this invention it has been found that a more satisfactory transformer coil may be provided which comprises a tubular coil structure having an inner layer of resinous material, a low-voltage winding of spirally wound enameled metal strip around the inner layer of resinous material, a second layer of resinous material around the low-voltage winding and overlapping the peripheral edges thereof, a high-voltage winding of enameled wire having a helically wound first layer of conductor turns around the second layer of resin and extending from one end of the tubular coil structure to the other thereof, a third layer of resinous material around the first layer of the high-voltage winding and over the outer edges thereof, a second layer of helically wound enameled wire wound around the third layer of resin and comprising a continuation of the first layer of the high-voltage winding and wound helically in the reverse direction of the first layer of the high-voltage winding, and a fourth layer of resinous material overlapping the second layer of the high-voltage winding and overlapping the opposite edges thereof.

The invention also comprises a method for making the foregoing tubular coil structure as set forth below.

The advantage of the device and method of this invention is that transformers without cellulose offer improved reliability by slowing thermal aging and by providing for the overlapping of resinous material along the opposite edges of the metal windings for avoiding arc-overs between proximate windings.

DESCRIPTION OF THE PREFERRED EMBODIMENTS

In accordance with this invention a method for making a non-cellulose insulated transformer coil comprises the following steps:

(a) providing a winding mandrel for repeated rotation past a resin applicator and a resin-curing station;

(b) applying a number of first layers of resinous material spirally onto the mandrel;

(c) winding a number of layers of a pre-insulated low-voltage metal strip spirally onto and around the layers of resin;

(d) applying a resinous layer onto the preinsulated metal strip of step (c) with the resinous coating overlapping opposite edges of the conductor;

(e) applying a second metal winding around the resinous coating of step (d) by applying a first layer of a pre-insulated wire helically onto the resinous layer of step (d) from one end thereof to the other;

(f) applying a third resinous coating onto the helically wound winding of step (e) with the resinous coating overlapping opposite edges of the conductor;

(g) winding a second layer of the pre-insulated wire by continuing to helically wind in the reverse direction from that of the conductor applied at step (e); and (h) applying a fourth layer of resin onto the helically wound conductor of step (g) and applying excess resin to cover opposite edges of the conductors wound at steps (f) and (g), whereby for each application of resinous layers at steps (d), (f) and (h) the resin is cured by rotating past the resin-curing station prior to the application of a subsequent step.

Figure 1:
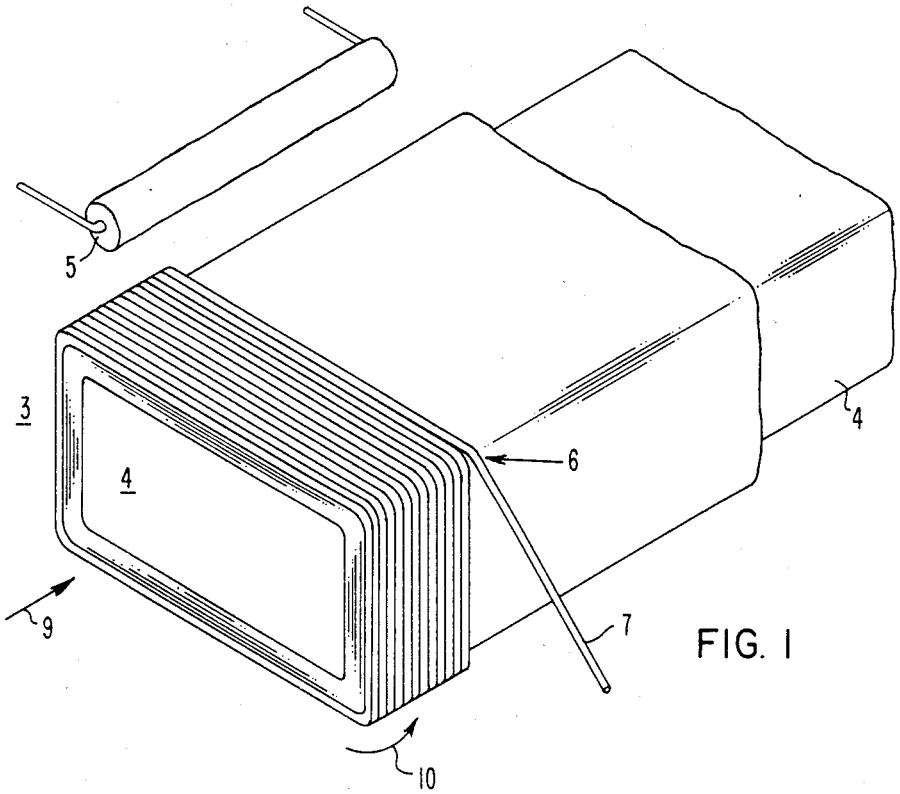
FIG. 1 is an isometric view of the transformer coil structure of this invention during winding.

In FIG. 1 a transformer coil is generally indicated at 3 and is a tubular member formed by applying consecutive layers of resin and metal conductors onto a rotating mandrel 4. As the mandrel turns it rotates past function stations including a resin applicator 5, a winding station 6 for applying conductors or windings such as a wire 7 onto the coil 3, and a curing station 9 for curing the resin during rotation of the mandrel through a 360° -turn thereof as indicated by the arrow 10.

Figure 2:
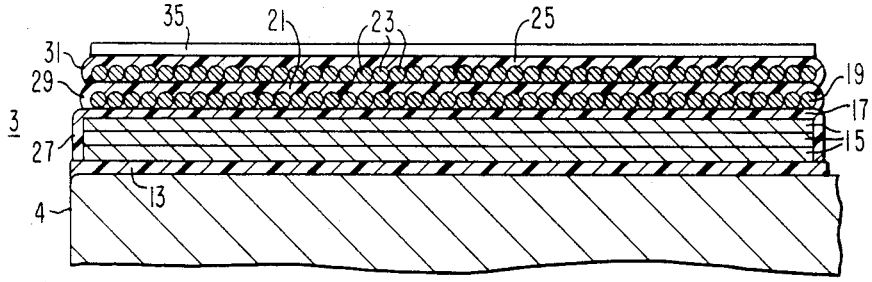
FIG. 2 is a vertical sectional view taken on the line 11—11 of FIG. 3.

As shown more particularly in FIG. 2 the coil 3 is wound upon the winding mandrel 4. The coil includes, in the order of their application, the following parts: a resinous layer 13, conductor winding 15, a resinous layer 17, conductor winding 19, a resinous layer 21, conductor winding 23, and a resinous layer 25. In addition, transformer coil 3 also comprises overlapping buildups 27, 29, 31, at opposite edges of each winding 15, 19, 23, respectively.

The resinous layer 13 is applied by the resin applicator 5 by the use of a suitable applicator, such as a paint roller. Practically, the layer 13 comprises a plurality of layers 13 applied repetitively in order to cover any holes, voids, or any other undesirable contaminant that would reduce the breakdown strength of the overall layer. For that reason a plurality of layers, such as from five to ten layers, are applied with each layer having a thickness of about 40 mils. The layers are applied spirally onto the rotating mandrel with each layer being cured or gelled in place at the curing station 9.

The curing station 9 may comprise any suitable radiation unit, such as infra-red, ultraviolet radiation or electron beam. Ultraviolet radiation appears to be practical.

The resin is preferably a high temperature resin, such as an acrylated epoxy, having an applied layer thickness of about 0.0005 to 0.0040 inch, i.e. 30 to 50 turns up to 4 mils thickness per turn.

The resin is applied and gelled in one or multiple thin layers depending on the desired insulating strength. Between layers of the low voltage windings another layer of resin may be applied.

After the requisite number of layers 13 are applied, the conductor winding 15 is applied at the winding station 6. The winding 15 preferably comprises a continuous strip of metal, such as copper, having an insulating coating, such as enamel, on the outer surface. As the mandrel is rotated successive winding layers, numbering from two to about fifteen may be applied spirally one upon the other and extending over the entire length of the coil 3 (FIG. 2).

Thereafter, the resinous layer 17 is applied over the outer turn of the winding 15. For that purpose a plurality of turns, such as from about 30 to 50 turns, of up to 4 mils thickness per turn is applied in a manner similar to the resinous layer 13 with each turn being cured at the curing station 9 as the mandrel 11 rotates. The resulting layer 17 has a thickness of from about $\frac{1}{8}$ inch to about 3/16 inch. It is preferred that more turns with a small thickness be applied to improve the dielectric strength of the overall layer.

Thereafter the conductor winding 19 is applied. It preferably includes the application helically of a continuous wire-like member having a round or rectangular cross section with an insulating coating, such as enamel, thereon. The winding 19 is conveniently applied by starting at the left axial end of mandrel 4 and winding helically to the right end as the mandrel rotates. The conductor winding 19 may be comprised of copper wire of a suitable gauge.

Upon completion of the helical winding of the conductor winding 19, the resinous layer 21 is applied in a manner similar to the application of the resinous layers 13, 17. Thus, each turn comprising the resinous layer 21 is applied by the resin applicator 5 from where it rotates on the turning mandrel past the curing station 9 leaving a gelled resinous layer 21.

Thereafter, the conductor winding 23 is applied as an extension of the wire forming the conductor winding 19. Thus, the conductor winding 23 is applied helically from left to right upon the layer 21 as shown in FIG. 2. The resinous layer 25 is then applied in a manner similar to the resinous layers 13, 17, 21, whereby each turn of the layer is applied by the resin applicator 5 and is cured at the curing station 9 as the mandrel 4 rotates.

The overlapping buildups 27, 29, 31 are applied during winding of the several conductor windings 15, 19, 23. That is, during each turn of the mandrel for the conductor winding 15 the resinous buildup 27 is applied to opposite edges thereof and subjected to a curing stage similar to the layers 13, 17, 21, 25. Likewise, the overlapped buildups 29 are applied at each end of the conductor winding 19 during application of said winding. Likewise, the overlapping buildups are applied at opposite edges of the conductor winding 23 upon completion thereof.

In the alternative, the overlapping buildups 27, 29, 31 may be applied by the application of wider turns of resin than is necessary to completely cover each conductor winding. In other words, opposite edges of each layer of the resinous layers 17, 21, 25 overlap each edge and are turned downwardly over opposite edges of the windings where they are cured in place. The purpose of the buildups 27, 29, 31 are to avoid arc-overs between the otherwise unexposed edges of the conductor windings 15 which are low-voltage windings, and the conductor windings 19, 23 which are high-voltage windings. The overlaps 27, 29, 31 ensure the avoidance of arc-overs between the edges of the conductor windings. It is understood that although the conductor winding 15 is comprised of an elongated spirally wound metal strip, a continuous wire may be used as an alternative and wound in a manner similar to the conductor windings 19, 23. Moreover, a continuous wire is wound helically in place as shown for the conductor windings 19, 23, conductor windings in the form of metal strip such as windings 15, may likewise be used as an alternative.

Finally, it is noted that the procedures here described are not limited to any number of layers in any coil, but may be iterated according to rating requirements.

Figure 3:
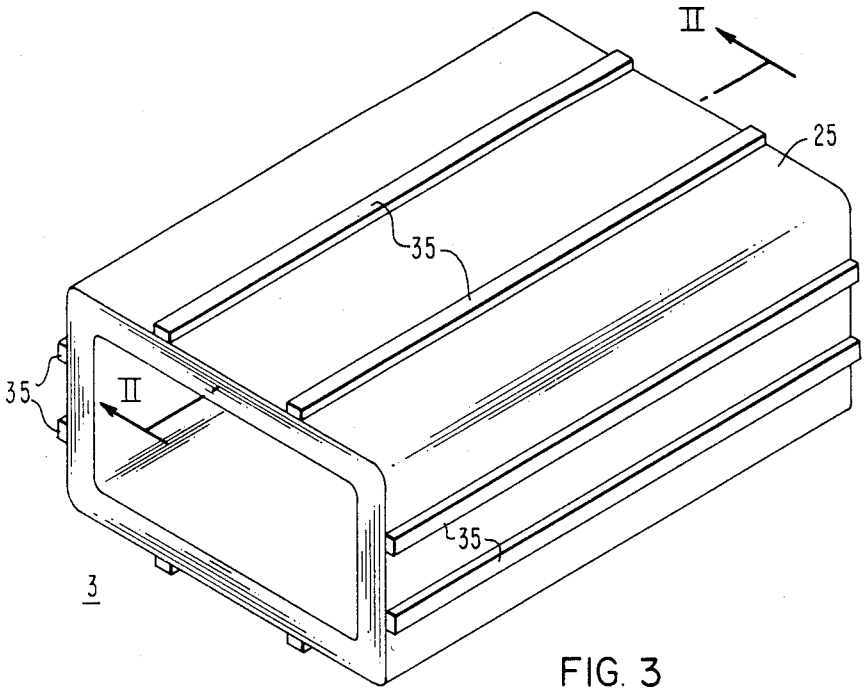
FIG. 3 is an isometric view of a completed coil structure.

Associated with the foregoing is the provision of ducts by which coolant oil may be circulated through the transformer in a conventional manner. For that purpose elongated strips 35 are placed at suitable locations (FIG. 3) upon the outer surface of the coil 3 as the resinous layer 25 is wound in place. Thus, the strips 35 of a suitable resin, such as polyethylene, are placed in position and as the mandrel 11 continues to rotate the strips are covered with outer layers 25 of resin until the winding is completed. Thereafter, the polyethylene strips 35 are melted out to provide coolant passage ducts within the resinous layer through which the coolant oil is free to pass.

Accordingly, a layer of insulation is formed and cured in place during coil winding at commercial winding speeds. Instead of applying a layer of paper a winder applies liquid resin of controlled viscosity which is instantly gelled by radiation cure. The consistency of the gelled resin is firm but not rigid, thus allowing mechanical support for winding of the subsequent layer and preventing misplacement of the layer by sliding. A coil structure is thus built up by reiterating the described sequence. Major insulation is likewise formed by applying layer on layer of resin. Ducts are also provided by winding in a strip of material which is removed when the coil is complete; i.e., polyethylene which can be melted out when the coil is energized prior to liquid fill in the transformer. The completed coil is then resin bound by a method which accommodates polymerization shrinkage during winding in contrast to conventional resin casting or potting techniques. In effect, the coil is simply a metal filament-wound cylinder with conductor space factor substantially improved over the paper-wound design because of the nesting of the conductors during winding.

With this concept the fluid function that is normally associated with oil is reduced from insulation and cooling to one of cooling alone. As far as the coil is concerned, the only limitation is the compatibility of the cooling medium with the resin insulation.

In conclusion, it is estimated that the cost of this system is competitive with or better than that of prior procedures because conductor mean turn is reduced, overall coil dimensions are reduced and as a result coil size (mean turn) is smaller, costly coil bonding and drying operations are eliminated, and oil impregnation problems are eliminated because oil is no longer part of the insulating system. Moreover, performance and operating reliability are improved because (1) the resin is not degraded by thermal aging at the rate of oil-paper, (2) the resin does not outgas during transformer operation as oil-paper does, (3) the coil structure is free of shrinkage voids, (4) the coil structure is resistant to vibration damage and short circuit, and (5) the conventional configuration of conductors avoids thick resin sections which present thermal gradient and thermal expansion problems particularly under electrical overload conditions.

What is claimed is:

1. A method of constructing a cellulose-free electrical winding structure in a substantially continuous operation, comprising the steps of:

providing winding support means, a liquid resin application station, and a resin gelling station;

providing relative rotating motion between the winding support means and the resin application and gelling stations;

forming a first winding layer having at least one conductor turn by applying a conductor to said winding support means;

providing electrical insulation on said first winding layer having a predetermined thickness dimension;

said step of providing electrical insulation including the steps of:

building up said electrical insulation in a plurality of turns by applying a thin coating of liquid resinous insulation from said liquid resin application station during each turn of said relative rotational motion, instantly gelling, in place, each turn of said liquid resinous insulation coating to a firmness sufficient to support a winding layer, and selecting the thickness of each turn of said liquid coating to accommodate shrinkage which occurs when the liquid coating gels turn by turn, to control and limit the maximum size of shrinkage voids;

and forming a second winding layer having at least one conductor turn by applying a conductor to the gelled resinous electrical insulation.

2. The method of claim 1 wherein the step of applying a conductor to the winding support means utilizes a wire conductor which is helically wound to form a layer having a plurality of conductor turns.

3. The method of claim 1 wherein the step of applying a conductor to the winding support means utilizes a strip conductor which is spirally wound to form a layer having a single conductor turn.

4. The method of claim 1 wherein the steps of forming the first and second winding layers utilize the same continuous conductor, to form winding layers of the same electrical winding.

5. The method of claim 1 wherein the steps of forming the first and second winding layers utilize different electrical conductors, to form winding layers of different electrical windings.

6. The method of claim 1 wherein the step of providing winding support means includes the step of forming the winding support means as part of the substantially continuous process, including the steps of building up the winding support means in a plurality of turns by applying a plurality of successive liquid layers of resinous insulation to a substrate, one upon the other, and instantly gelling each layer thereof before the application of a succeeding layer of liquid resinous insulation.

7. The method of claim 1 wherein the steps of forming the insulated winding layers are reiterated to provide an electrical winding having a predetermined number of layers of conductor turns.

8. The method of claim 7 wherein the step of applying successive coatings of liquid resinous insulation to build up electrical insulation turn by turn includes the steps of overlapping the axial ends of the already applied winding layer with the liquid resinous insulation, and the gelling step instantly gels each of said overlaps.

9. The method of claim 7 wherein at least certain of the overlapping steps additionally overlap the prior gelled overlaps applied to the ends of preceding winding layers.

10. The method of claim 7 including the steps of introducing heat meltable strips of material between at least certain of the layers of conductor turns, and subsequently removing said material to provide coolant ducts by melting the strips by the application of heat.

11. The method of claim 1 including the steps of applying liquid resinous insulation to the axial ends of the winding layers, and instantly gelling said resinous insulation.

12. The method of claim 1 wherein the step of applying a thin coating of liquid resinous insulation to the winding layer includes overlapping the axial ends of the layer with the liquid resinous insulation, with the gelling step also gelling the resinous insulation applied to the ends of the winding layer.

13. The method of claim 1 wherein the winding support means includes a prior applied winding layer.

* * * * *